US005893418A

United States Patent [19]

Ponte

[11] Patent Number: 5,893,418

[45] Date of Patent: Apr. 13, 1999

[54] SPRINKLE GUARD

[75] Inventor: Gary W. Ponte, Livingston, N.J.

[73] Assignee: The Reliable Automatic Sprinkler Co., Inc., Mount Vernon, N.Y.

[21] Appl. No.: 08/990,656

[22] Filed: Dec. 15, 1997

[51] Int. Cl.[6] ..... A62C 37/08; B05B 1/28

[52] U.S. Cl. ..... 169/37; 169/51; 239/288; 239/288.3

[58] Field of Search ..... 169/37, 51; 239/288, 239/288.3, 288.5, 200, 208, 209

[56] References Cited

U.S. PATENT DOCUMENTS

| | | | |
|---|---|---|---|
| 1,075,053 | 10/1913 | Moore | 239/288.5 X |
| 1,469,336 | 10/1923 | Rowley | 169/51 |
| 3,361,364 | 1/1968 | Purtell | 239/288.5 |
| 3,514,040 | 5/1970 | Carson | 239/288.5 |
| 3,797,746 | 3/1974 | Gray et al. . | |
| 5,632,339 | 5/1997 | Fenske et al. . | |

*Primary Examiner*—Andres Kashnikow
*Assistant Examiner*—Robin O. Evans
*Attorney, Agent, or Firm*—Baker & Botts, L.L.P.

[57] ABSTRACT

In the particular embodiments described in the specification, a sprinkler guard is formed from eight U-shaped wire members arranged uniformly about a sprinkler axis and joined at one end to a ring and at the other end to two opposed base plates which each receive four of the U-shaped members, leaving an opening through which a conventional sprinkler head can be inserted into the guard. The base plates have downwardly projecting portions with opposed surfaces to engage flat outwardly facing surfaces on the conventional sprinkler head and also have outwardly facing surfaces for receiving a wrench to mount the sprinkler head after the guard has been assembled on it.

7 Claims, 6 Drawing Sheets

SPRINKLE GUARD

BACKGROUND OF THE INVENTION

This invention relates to sprinkler guards for protecting sprinkler heads, especially those having thermally responsive elements.

Fire protection sprinklers normally include a thermally responsive element designed to release a closure to permit water to be passed through the sprinkler when the temperature exceeds a selected level and a deflector to distribute the water. The thermally responsive element may, for example, be a glass bulb or a eutectic solder composition normally maintaining an assembly of components which support a cap so as to prevent release of water through the sprinkler head. Such thermally responsive elements and sprinkler deflectors may be subject to damage or destruction if struck by objects being moved in the vicinity of the sprinkler head.

Heretofore, sprinkler guards in the form of wire cages have been mounted on a sprinkler head, either before or after the head is assembled to a water supply line, but such prior art arrangements have certain disadvantages. In the patent to Gray et al. U.S. Pat. No. 3,797,746, for example, a sprinkler guard assembled from wire members is mounted on a sprinkler head by two of the wire members which embrace the sprinkler head in the region adjacent to the threaded portion by which the sprinkler head is mounted in a threaded receptacle. The wire members form two opposed loops which engage oppositely directed flat surfaces on the sprinkler head arranged to receive a wrench for use in mounting the sprinkler head in a threaded receptacle.

Consequently, with this arrangement it is necessary to mount the sprinkler head in a threaded receptacle connected to a water line before the sprinkler guard can be affixed to the head. This requires the guard to be assembled to the head when the head is in an inconvenient position adjacent to a ceiling, for example, or disposed over storage racks.

The Fenske et al. U.S. Pat. No. 5,632,339 discloses a sprinkler guard which avoids the foregoing problem by providing a sprinkler head having a special structure which includes a first region adjacent to the threaded end of the sprinkler head which is shaped to receive a wrench to mount the sprinkler in a threaded receptacle and a second region on the opposite side of the first region from the threaded end which is designed to receive a base portion of a sprinkler guard. With this arrangement, a sprinkler guard can be assembled to a sprinkler head before the head is mounted in a threaded receptacle of a water line but, in order to accomplish this, a specially designed sprinkler head is required.

SUMMARY OF THE INVENTION

Accordingly, it is an object of the present invention to provide a sprinkler guard for fire protection sprinklers which overcomes the above-mentioned disadvantages of prior art.

Another object of the invention is to provide a sprinkler guard which can conveniently be mounted on a conventional sprinkler head while permitting the sprinkler head to be subsequently assembled to a threaded receptacle.

These and other objects of the invention are attained by providing a sprinkler guard comprising a wire structure having openings to permit water to be sprayed from an enclosed sprinkler head and a base portion supporting the wire structure including base plates with portions projecting parallel to the axis of a conventional sprinkler head on which the guard is to be mounted providing inner surfaces arranged to engage flat surfaces located adjacent to a threaded end of the sprinkler head, and exposed outer flat surfaces for engagement by a wrench to mount the sprinkler head in a threaded receptacle. In a preferred embodiment, the sprinkler guard includes two sets of wire members forming opposed portions of the guard and extending on opposite sides of a conventional sprinkler head on which the guard is mounted, and two base plates to which the sets of wire members are affixed, respectively, each base plate having a surface arranged to engage a flat surface of a conventional sprinkler head located adjacent to the threaded end so that the surfaces of the two base plates embrace the part of the sprinkler head normally used to receive a wrench for mounting the sprinkler head and provide outer surfaces to receive a wrench.

BRIEF DESCRIPTION OF THE DRAWINGS

Further objects and advantages of the invention will be apparent from a reading of the following description in conjunction with the accompanying drawings, in which.

DESCRIPTION OF PREFERRED EMBODIMENTS

Figure 6:
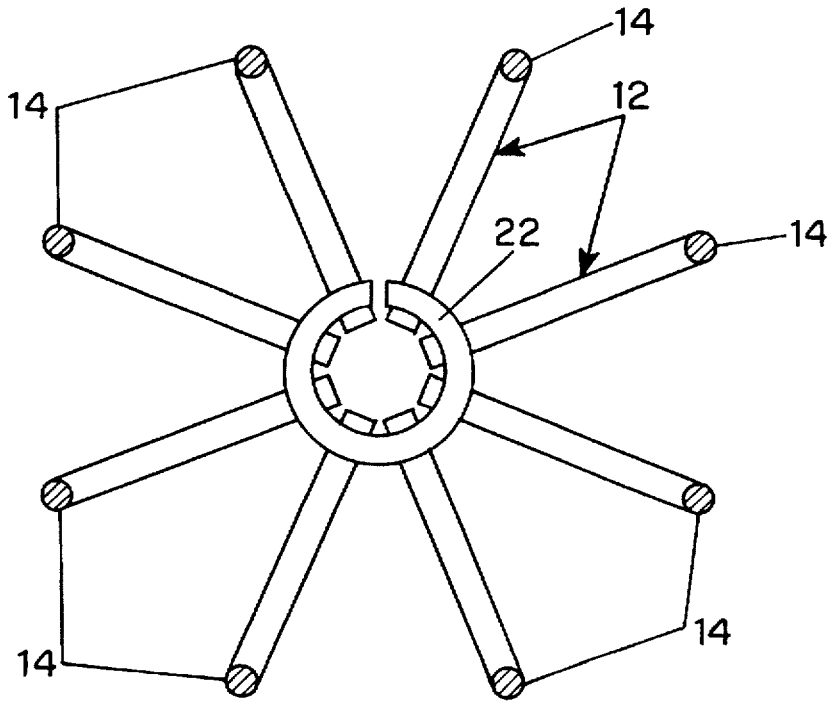
FIG. 6 is cross-sectional view of the sprinkler guard shown in FIG. 5 taken on the line VI—VI in FIG. 5 and looking in the direction of the arrows toward the top of the guard.

In the typical embodiment of the invention illustrated in the drawings, a sprinkler guard 10 is made of a plurality of generally U-shaped wire members 12 having base portions 14 aligned parallel to the axis 16 of a conventional upright sprinkler head 18 on which the guard is mounted, the sprinkler head having a threaded end 19 and including a conventional thermally responsive element 20 and a deflector 21. As shown in the sectional view of FIG. 6, the U-shaped wire members 12 are distributed at uniform angles about the axis 16 of the sprinkler and are joined as by welding at their upper ends to a ring member 22.

Figure 1:
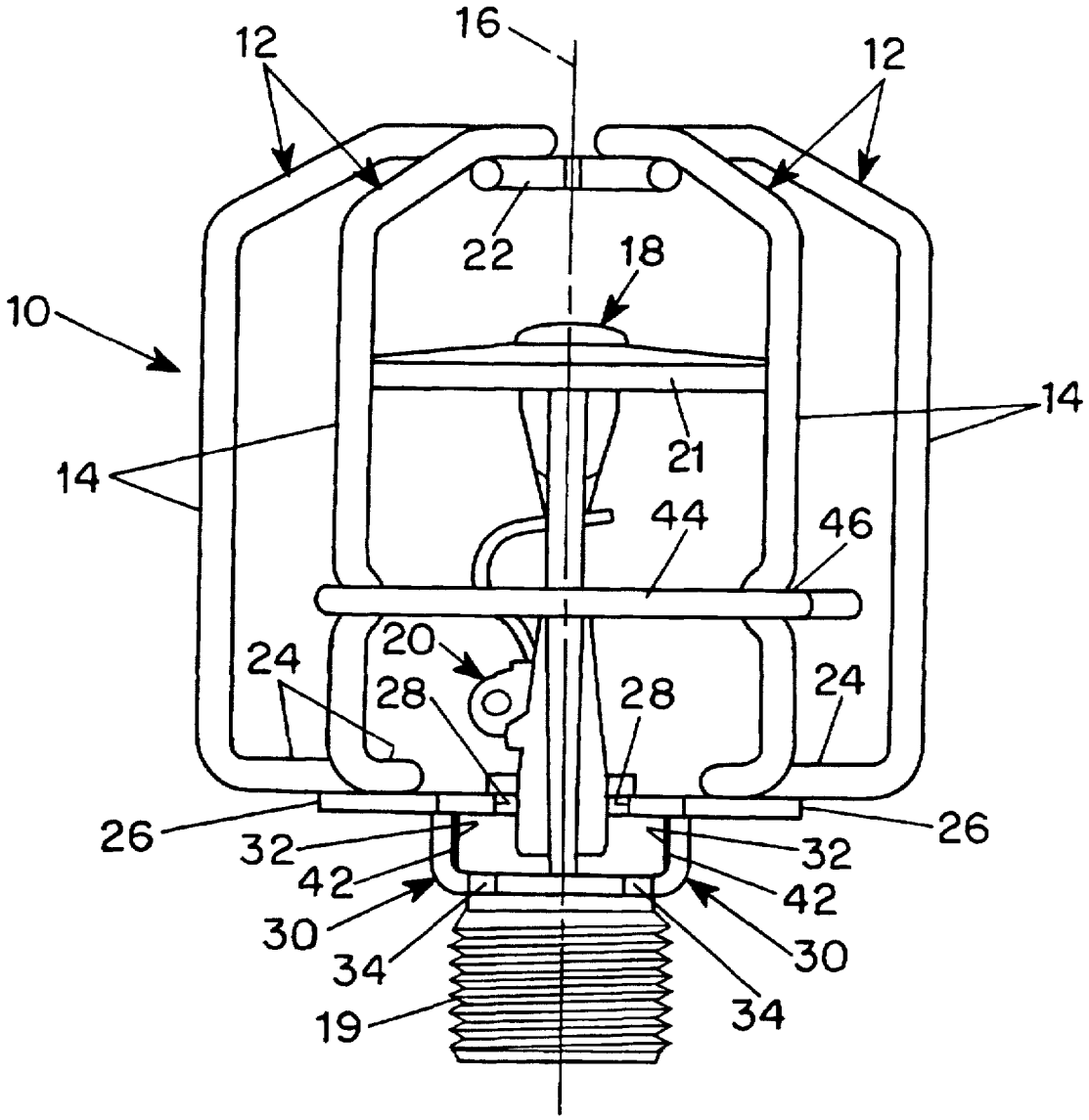
FIG. 1 is a side view of a representative embodiment of a sprinkler guard arranged according to the invention mounted on a conventional upright sprinkler head.
Figure 2:
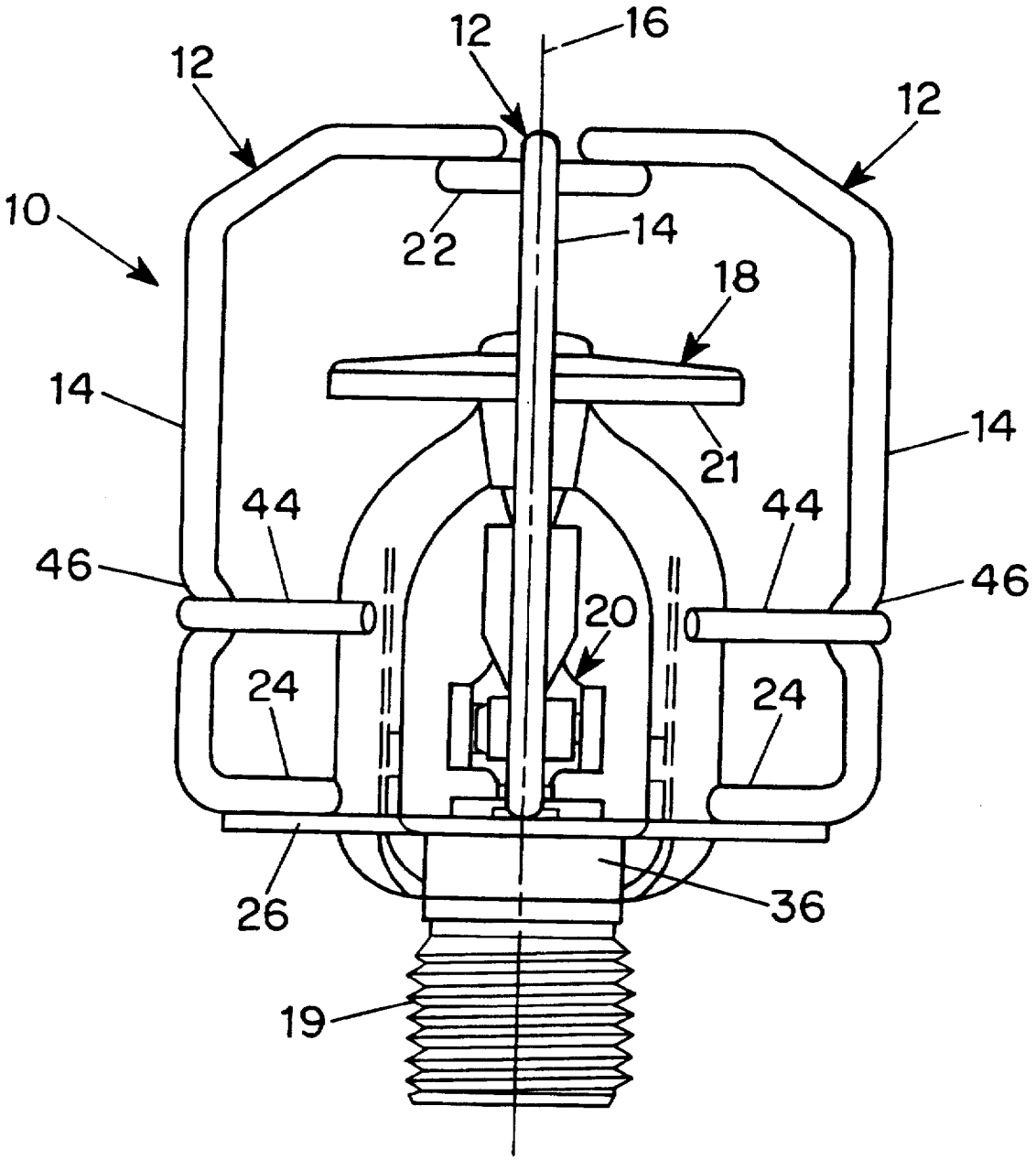
FIG. 2 is another side view of the sprinkler guard shown in FIG. 1 looking at a right angle to the view shown in FIG. 1.
Figure 5:
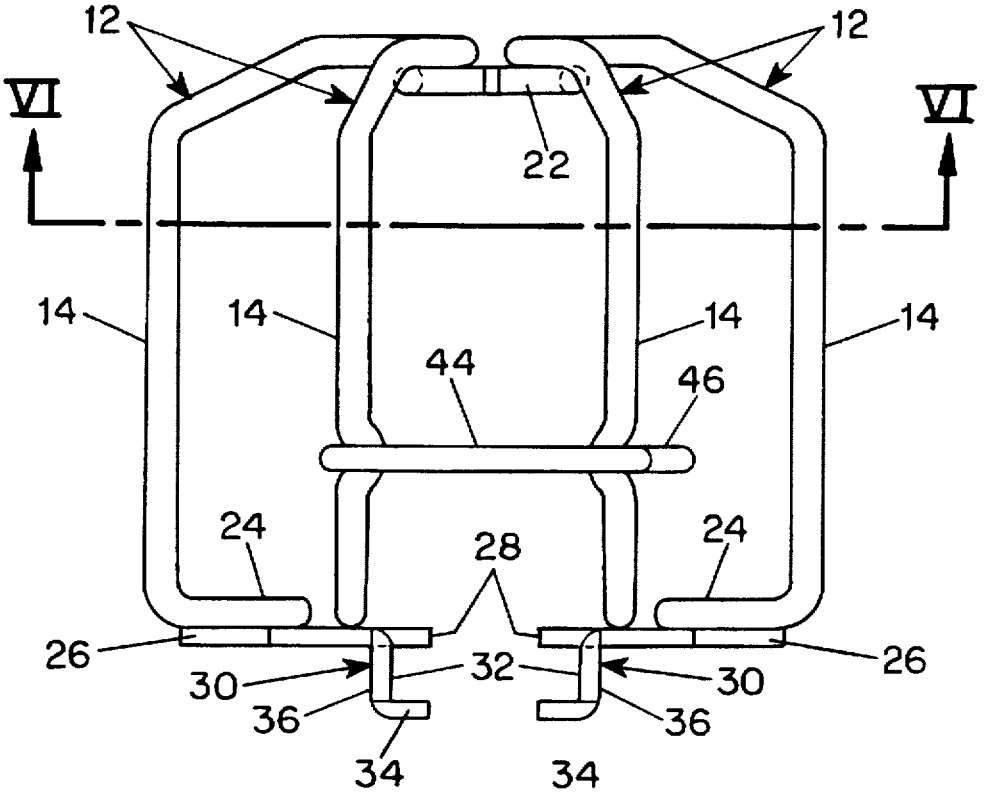
FIG. 5 is a side view of the sprinkler guard shown in FIG. 1.
Figure 7:
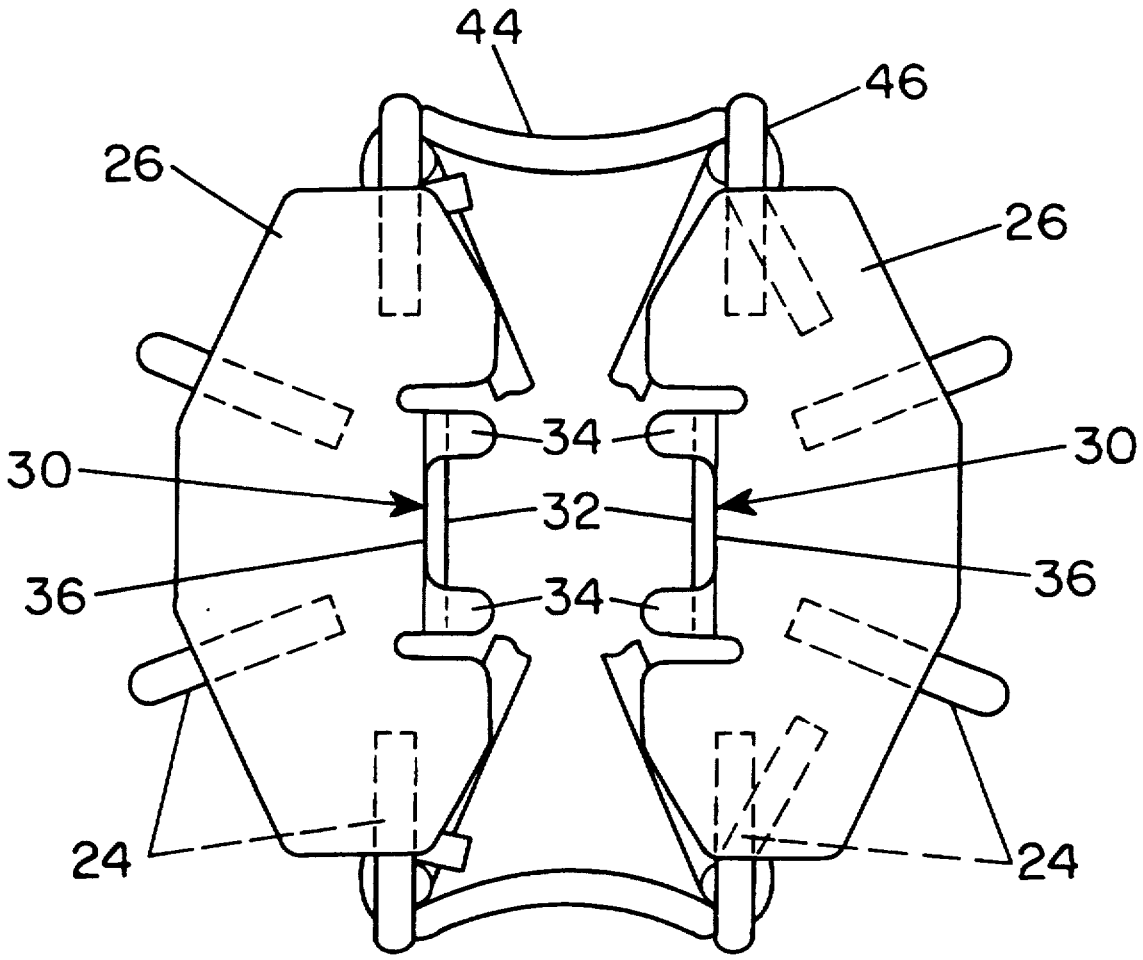
FIG. 7 is a bottom view of the sprinkler guard shown in FIG. 5.

In the illustrated embodiment, there are eight U-shaped wire members and, as shown in FIGS. 5 and 7, the lower ends 24 of the U-shaped members 12, as seen in the upright sprinkler embodiment of FIGS. 1 and 2, are joined as by welding to two base members in the form of plates 26 having opposed edges 28 located on opposite sides of the axis 16 in a plane perpendicular to the axis. If desired, the guard may have more or fewer than eight U-shaped members and the base members may be formed from wire rather than being in plate form.

Each of the base members 26 includes a portion 30 which projects downwardly in a direction perpendicular to the plane of the base plate providing inner surfaces 32 which extend parallel to each other and face the axis 16. At the lower ends of the inner surfaces 32, each portion 30 has two tabs 34 which project inwardly therefrom toward a plane extending through the axis 16 between the base plates. The downwardly projecting portions 30 of the base members also have outer surfaces 36 which extend parallel to the inner surfaces 34.

As shown in FIGS. 5 and 7, the lower ends 24 of four of the U-shaped wire members 13 are affixed to each of the plates 26 so that the guard has two spaced sections joined at their upper ends by the ring member 22. The wire members are sufficiently resilient that the two sections can be urged apart, if necessary, to enlarge the space between the base plates 26 and between adjacent wires 12 of the guard to permit the deflector 21 of the conventional sprinkler head 18 to pass between the adjacent wires 12. The conventional sprinkler head 18 is formed in the usual manner with two outwardly facing flat wrenching surfaces 42 which are normally used to mount the threaded end 19 of the sprinkler head in a threaded receptacle and these surfaces are engaged by the opposed inner surfaces 34 of the base plates 26 when the guard is mounted in position on the sprinkler head.

After the guard has been placed on a sprinkler head in this manner, the two sections of the guard are locked together on the sprinkler head by two wire clips 44, each pivotally supported on a wire member 12 adjacent to the spaces between the sections which engage a clip receiving portion 46 in an adjacent wire member of the opposite section so as to clamp the two sections of the guard together on the sprinkler head.

With this arrangement, sprinkler head 18 and its thermally responsive portion 20 and deflector 21 are effectively protected against damage from being struck by objects moving in the vicinity of the sprinkler. Moreover, the downwardly projection portions 30 of the opposed base plates 26 provide the outwardly facing surfaces 36 for engagement by a wrench so that the sprinkler head can be mounted in a threaded opening using a wrench after the guard has been mounted on the sprinkler head.

Figure 3:
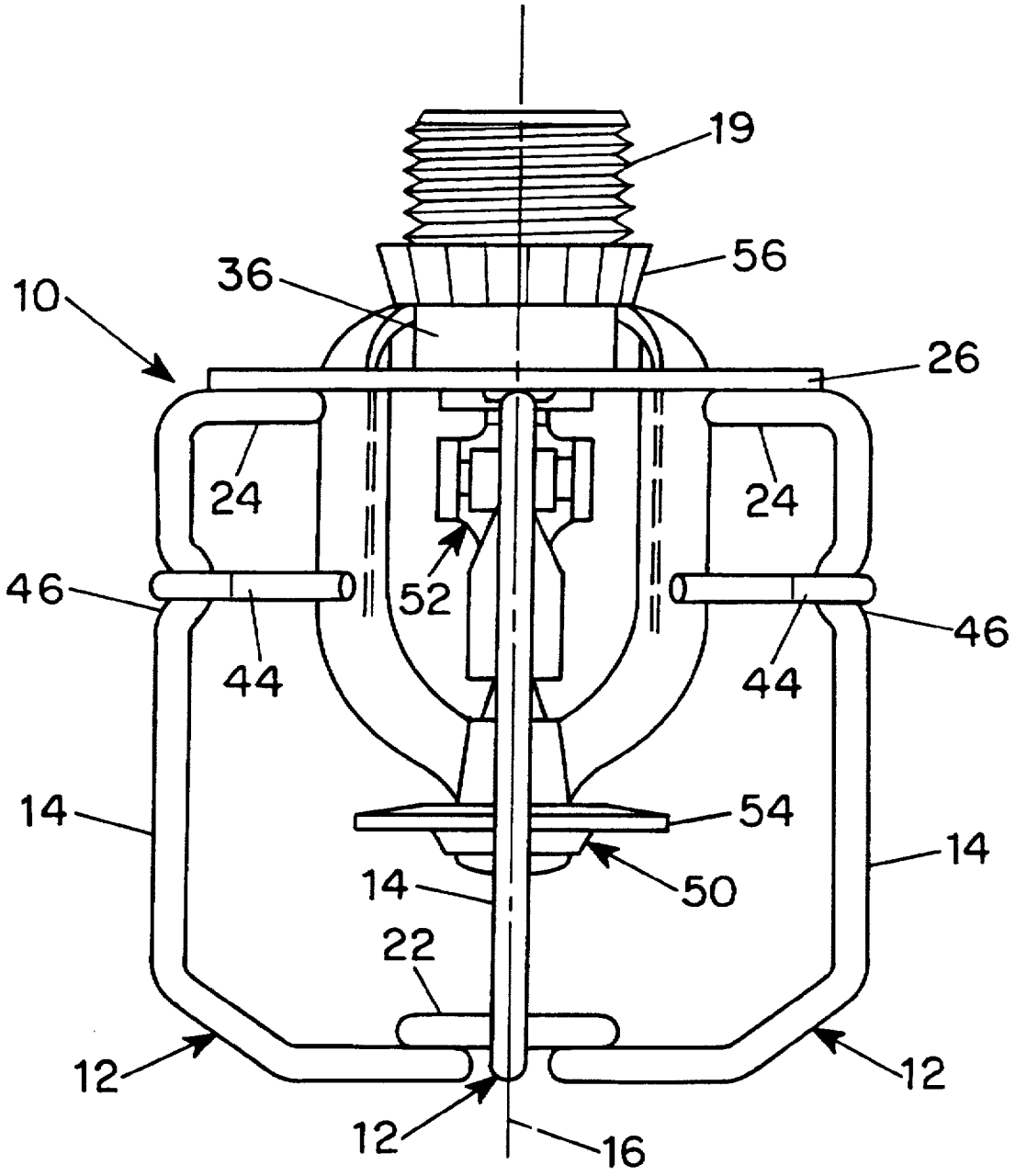
FIG. 3 is a side view of a sprinkler guard according to the invention mounted on a conventional pendent sprinkler head.
Figure 4:
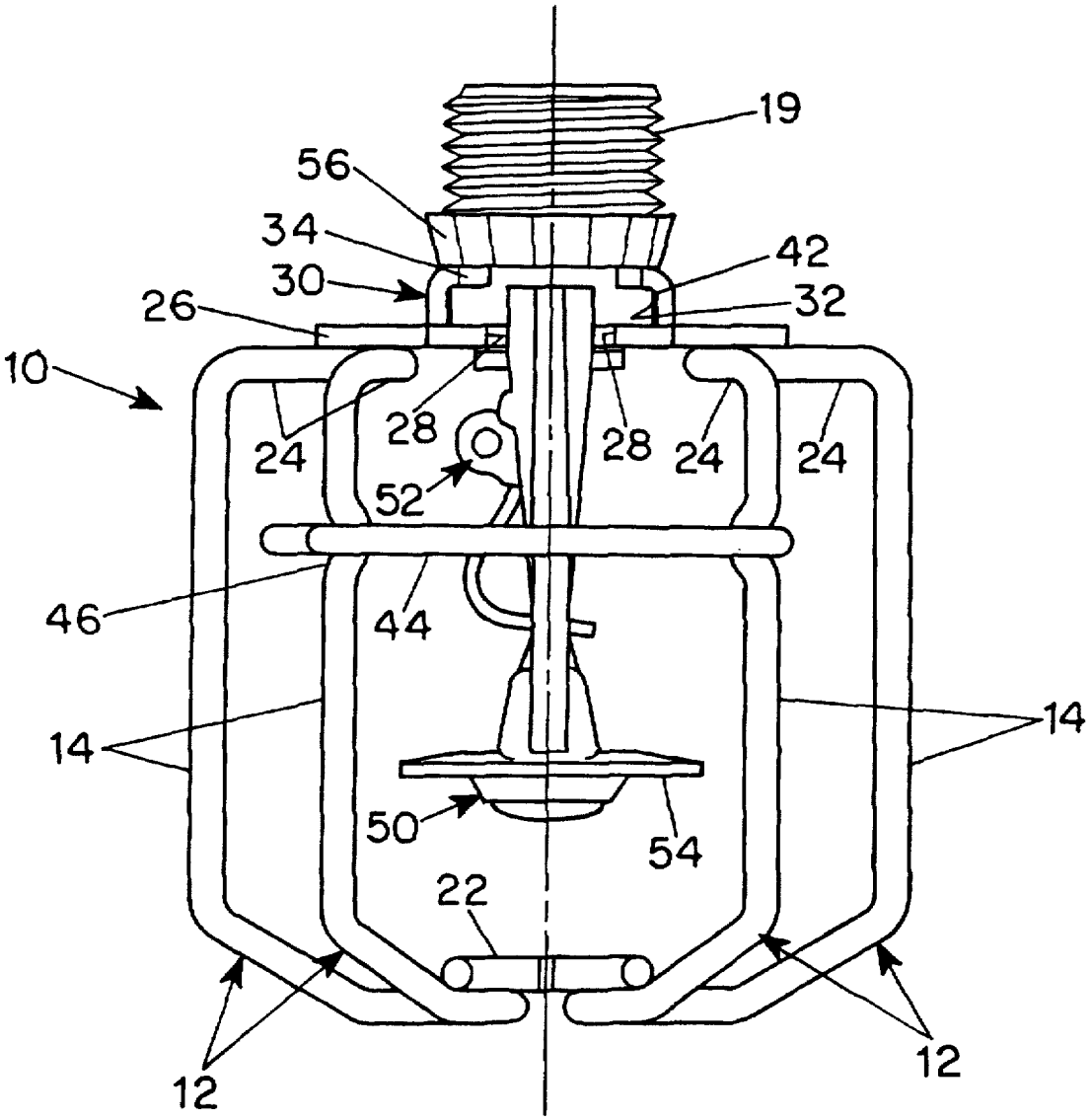
FIG. 4 is a side view of the guard shown in FIG. 3 looking at a right angle to the view shown in FIG. 3.

FIGS. 3 and 4 illustrate a conventional pendent sprinkler 50 having a thermally responsive element 52 and a deflector 54 on which the same sprinkler guard 10 has been mounted. In the same way, the sprinkler guard of the invention may be mounted on any other type of conventional sprinkler head, such as a horizontal sprinkler head or a bidirectional sprinkler head. In addition, FIGS. 3 and 4 illustrate a stabilizing nut 56 which can be threaded onto the threaded portion 19 of the sprinkler so as to be clamped against the tabs 34 of the guard and increase the stability of the guard, if desired.

Although the invention has been described herein with reference to specific embodiments, many modifications and variations therein will readily occur to those skilled in the art. Accordingly, all such variations and modifications are included within the intended scope of the invention.

I claim:

1. A sprinkler guard for protecting a sprinkler head comprising:

a plurality of wire members forming a wire portion of a guard to receive a sprinkler head;

two base members to which two opposed pluralities of the wire members are affixed leaving an opening to permit the guard to be received on a conventional sprinkler head; and opposed parallel projections from the base members extending away from the wire portion and having inner surfaces for engagement with opposed outwardly facing surfaces of a sprinkler head and having outer flat surfaces to receive a wrench for mounting of a sprinkler head on which the sprinkler guard is mounted.

2. A sprinkler guard according to claim 1 including clamping means for clamping together the two pluralities of wire members.

3. A sprinkler guard according to claim 2 wherein the clamping means comprises a pivoted link supported on a wire member of one plurality and adapted to engage a wire member of the other plurality.

4. A sprinkler guard according to claim 1 wherein all of the wire members are attached at one end to a centrally disposed ring member.

5. A sprinkler guard according to claim 1 wherein the opposed parallel projections from the base members have tabs extending parallel to the base members at ends opposite to the base members.

6. A sprinkler head comprising:

a threaded end to be received in a threaded receptacle of a water line;

at least two outwardly facing flat surfaces on opposite sides of the sprinkler head providing a wrench-receiving portion of the head adjacent to the threaded end to receive a wrench to enable mounting of the sprinkler head in a threaded receptacle;

a deflector; and a sprinkler guard mounted on the sprinkler head comprising a plurality of wire members having portions extending generally parallel to a sprinkler axis and being joined at ends remote from the threaded end of the sprinkler head; and two opposed base members to which ends of the wire members adjacent to the threaded end of the sprinkler head are affixed, the base members having opposed projecting portions extending toward the threaded end of the sprinkler in planes parallel to the outwardly facing flat surfaces of the sprinkler head and having outer flat surfaces to receive a wrench for mounting of the sprinkler head after the guard has been mounted on the sprinkler head.

7. A sprinkler head according to claim 6 wherein the opposed projecting portions of the base members are provided with tabs extending toward the axis of the sprinkler head; and a nut threaded on the threaded portion of the sprinkler head engaging the tabs to retain the sprinkler guard in position on the sprinkler head.

* * * * *